United States Patent [19]

Haeussler

[11] 3,982,372

[45] Sept. 28, 1976

[54] FACADE WALL ASSEMBLY

[76] Inventor: Ernst Haeussler, Grashofstrasse 47, 4300 Essen-Bredeney, Germany

[22] Filed: Jan. 20, 1976

[21] Appl. No.: 650,683

[30] Foreign Application Priority Data

Feb. 4, 1975 Germany ..... 2504454

[52] U.S. Cl. ..... 52/513; 52/235; 52/378

[51] Int. Cl.[2] ..... E04B 2/88

[58] Field of Search ..... 52/235, 378, 486, 583, 52/587, 513, 511, 562, 565; 248/476, 327

[56] References Cited

UNITED STATES PATENTS

| | | | |
|---|---|---|---|
| 1,468,285 | 9/1923 | Dampney | 52/565 |
| 1,724,284 | 8/1929 | Imshenetsky | 52/562 |
| 3,760,542 | 9/1973 | Haeussler | 52/235 |

FOREIGN PATENTS OR APPLICATIONS

| | | | |
|---|---|---|---|
| 2,027,219 | 12/1971 | Germany | 52/235 |

*Primary Examiner*—John E. Murtagh
*Attorney, Agent, or Firm*—Karl F. Ross; Herbert Dubno

[57] ABSTRACT

A facade wall plate is provided on its back face with a steel stranded-wire loop into which is hooked the lower end of a hanger whose upper end is hooked over a similar such loop projecting from the front face of a support wall. The hanger may be a turnbuckle wherein rotation of a central sleeve shortens the distance between the hanger ends for positioning the facade, or at least one end of the hanger may be slidable along the hanger by a rotatable nut for varying the hanger length. Each such loop is formed by a continuous loop of cable imbedded in the respective facade plate or wall and looped therein around the reinforcement thereof.

12 Claims, 7 Drawing Figures

FIG. 5
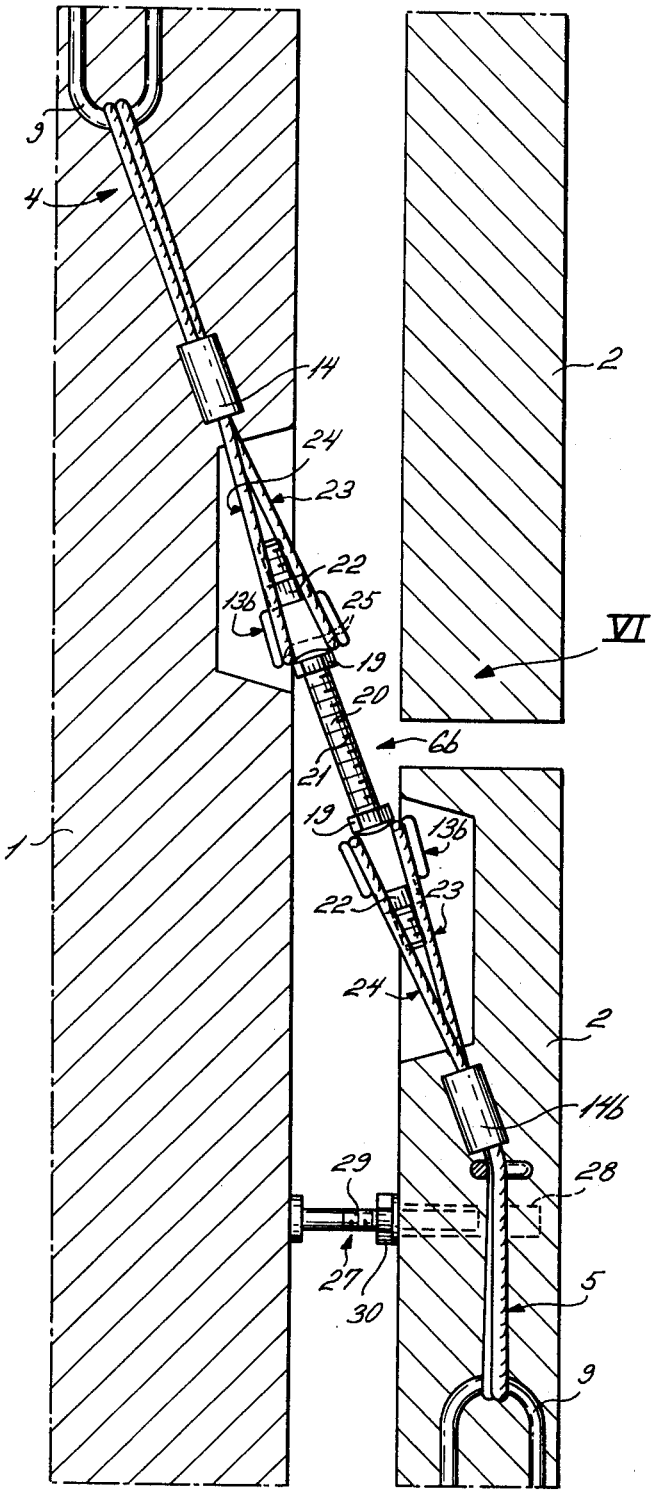
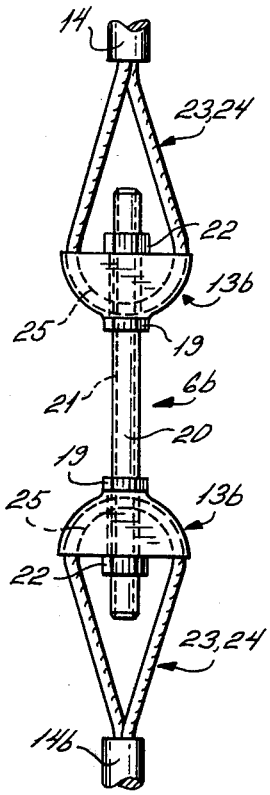
FIG. 6

FACADE WALL ASSEMBLY

Field of the Invention

The present invention relates to a wall assembly. More particularly this invention concerns such an assembly wherein a plurality of decorative and heavy facade plates are secured via hangers to a wall.

BACKGROUND OF THE INVENTION

A building construction method is known wherein the side walls of the building are formed of reinforced concrete or the like and are provided with an array of anchors over the outer face of this side wall. Decorative facade plates are themselves provided with anchors on their back faces and hangers are hooked between the anchors on the wall and on the facade plates to secure these plates to the wall. Such an arrangement allows a relatively inexpensive but extremely strong reinforced concrete wall to be given a very attractive appearance with facade plates simply hung on the wall.

The anchors in the wall and in the facade plates are usually provided in pockets on the confronting faces of these elements. It is known to provide a steel bar set in the concrete of the wall and constituting the lower edge of the pocket and to use an eye in the facade plate, the hanger being hooked into the eye in the facade plate and over the reinforced lower edge of the pocket on the wall. Spacers are provided on the wall or on the facade plate to hold the two apart by a predetermined distance and allow the facade plate to be positioned exactly vertically even if the backing wall is slightly out of true.

Such an arrangement has the disadvantage that the anchors to which the hanger is hooked must be very accurately positioned. Any misalignment of these anchors must be made up for by the hanger, which is usually only made, for instance, to be suspended vertically. If the anchors on the facade is horizontally offset from the overlying anchor on the wall the hanger to be hooked therebetween must be canted, frequently in a position that greatly reduces its strength.

Furthermore with the known systems the anchors on the facade plates are frequently damaged during transport. When these anchors are constituted an eyes they are frequently bent in or even broken off during transport, requiring the entire expensive facade plate to be discarded.

OBJECTS OF THE INVENTION

It is therefore an object of the present invention to provide an improved wall assembly.

Another object is the provision of an improved facade plate for such an assembly.

Yet another object is the provision of an improved arrangement for hanging facade plates on a wall.

SUMMARY OF THE INVENTION

These objects are attained according to the present invention in an arrangement wherein the anchor on the facade plate at least is constituted as a loop of stranded wire, steel stranded wire rope being particularly usable. Such an anchor is almost indestructible during transport of the facade plate and readily allows the hanger to extend at an angle to the vertical with perfect force transmission between the anchor and the hanger.

According to another feature of this invention the anchor on the wall is similarly constituted and the hanger between them is of variable length to allow the vertical position of a facade plate to be exactly adjusted.

In accordance with further features of this invention the back face of the facade panel is formed with pockets in which anchor loops are provided, and the front face of the wall in which the facade plate is to be hung is formed with similar pockets in which anchor loops are provided. The loops are imbedded well within the respective elements and may be connected to the reinforcement thereof. In this manner very inexpensive yet strong anchors are obtained.

According to yet another feature of this invention the hanger is a turnbuckle arrangement having a pair of oppositely threaded rods screwed into opposite ends of a central sleeve. Each of these rods has a T-shaped head that is fitted within the loop of the respective anchor. The crosspiece of the T-head lies generally tangent and orthogonal to the shaft of the threaded rod so that the turnbuckle arrangement lies directly in line with the two cable loops.

In accordance with another feature of this invention the hanger is constituted as a T-shaped bar having a threaded shank passing through a T-shaped slider bearing against a nut threaded onto the shaft of the hanger. The nut can be screwed down to vary the effective length of the hanger between its T-ends which again need not even lie parallel to one another.

According to yet another feature of the present invention the hanger is formed principally of a threaded rod on each of whose ends is screwed a head formed with a saddle-shaped groove receiving a respective anchor loop. Nuts serve to position these heads on the threaded rods to alter its effective length. In such an arrangement each anchor may be formed of two such loops that lie to opposite sides of the rod for most even force transmission and greatest suspension strength.

With all such systems the facade plate is spaced from the supporting wall by adjustable spacers that allow a plurality of such facade plates to be secured one above the other with their outer surfaces exactly planar even when the support wall is rough or out of true. The loops are constituted from endless pieces of cable joined together by pressed-on sleeves.

With the system according to the present invention if the anchor on the facade plate is not directly under the respective anchor on the support wall the hanger can nonetheless effectively interconnect the two, lying somewhat canted to the wall along a nonvertical plane orthogonal to the support wall. Furthermore such cable loops are very easy and inexpensive to manufacture. It is almost impossible to damage them during transport of the facade plate and yet they can support enormous loads.

BRIEF DESCRIPTION OF THE DRAWING

FIGS. 4 and 5 are vertical sections through two other arrangements in accordance with this invention;

FIG. 6 is a view taken in the direction of arrow VI of FIG. 5; and

SPECIFIC DESCRIPTION

Figure 1:
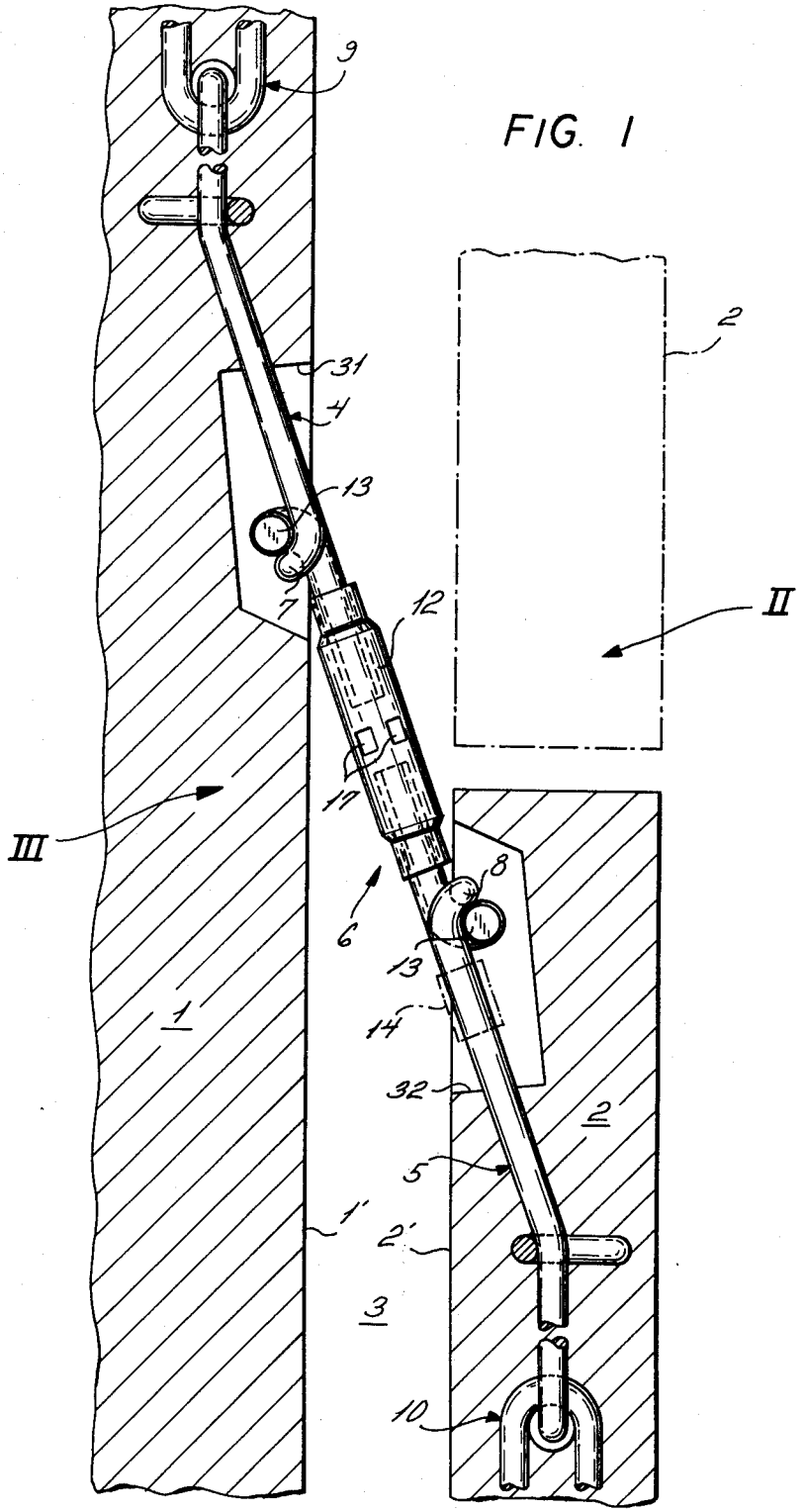
FIG. 1 is a vertical section through a wall structure in accordance with this invention.
Figure 2:
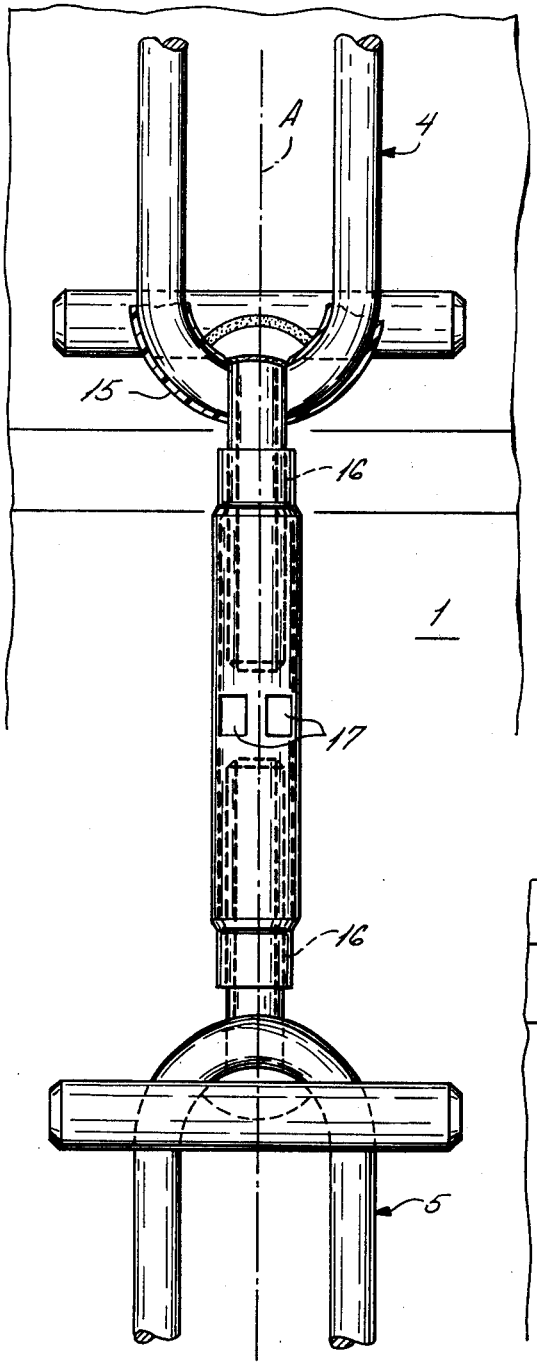
FIGS. 2 and 3 are views taken of the system of FIG. 1 in the direction of arrows II and III, respectively, of FIG. 1.
Figure 3:
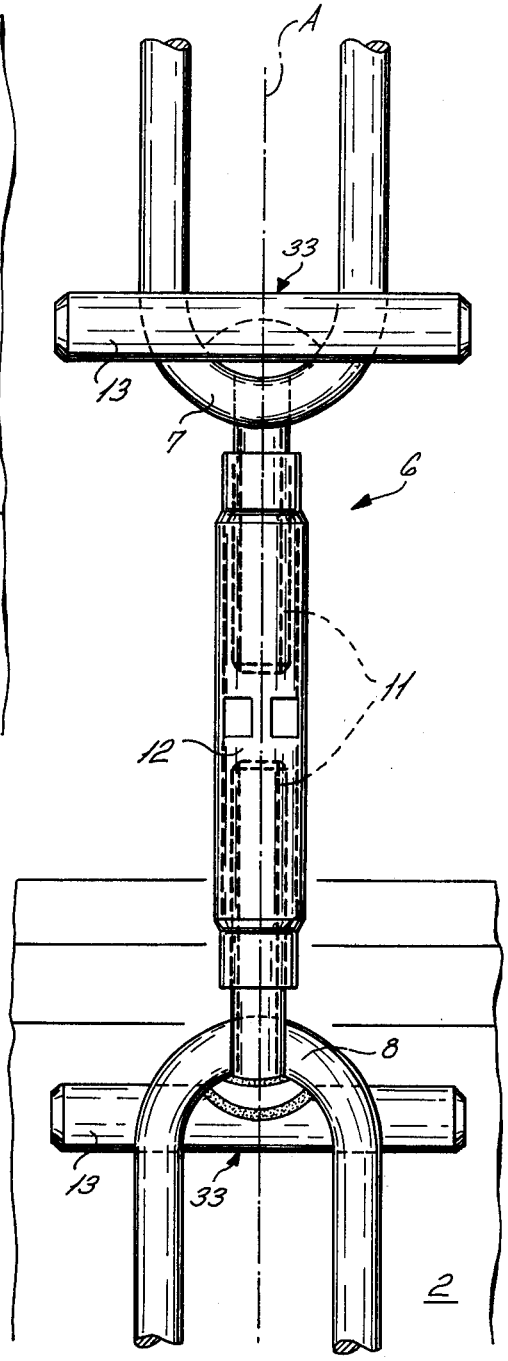

FIGS. 1-3 show a reinforced-concrete wall 1 having a front face 1′ defining a space 3 with the back face 2′ of a reinforced-concrete decorative facade plate 2. A hanger 6 is connected between an anchor 4 in a pocket 31 formed in the face 1′ and another anchor 5 in a pocket 32 of the face 2′. These anchors 4 and 5 are constituted as steel wire-rope loops 7 and 8 imbedded within the wall 1 and facade plate 2 and connected to the reinforcement 9 and 10 in these elements, respectively.

The hanger 6 is formed of three parts: a sleeve 12 formed with two in-line threads 11 of opposite hand, and two T-shaped parts 33 each constituted by a threaded shank 11 received in the respective thread 16 and a crosspiece 13 that extends at a right angle to the axis A of the sleeve 12 and shanks 11 and which is welded to the end of the respective shank 11 tangential to the surface of this shank 11, as shown in FIG. 1. The sleeve 12 is formed with holes 17 so that a screwdriver or similar tool may be engaged with this sleeve 12 and rotated to approach the two elements 33 toward each other or displace them away from each other. The crosspiece 13 of each element 33 is kept to that side of the tank 11 toward the respective surface of the respective anchor so that the axis A is aligned between the two loops 7 and 8.

These loops 7 and 8 are formed by closed loops of steel stranded wire rope of the moderately flexible type having virtually no longitudinal extensibility. A connector sleeve 14 is used to close the loop that is formed of a single piece of such stranded wire rope. This rope may also be covered with a synthetic-resin protective coating as is shown at 15 in FIG. 2 in order to prevent it from corroding.

The elements 33 are formed of circular-section steel rod and are advantageously galvanized. The sleeve 22 is similarly steel and galvanized.

Figure 4:
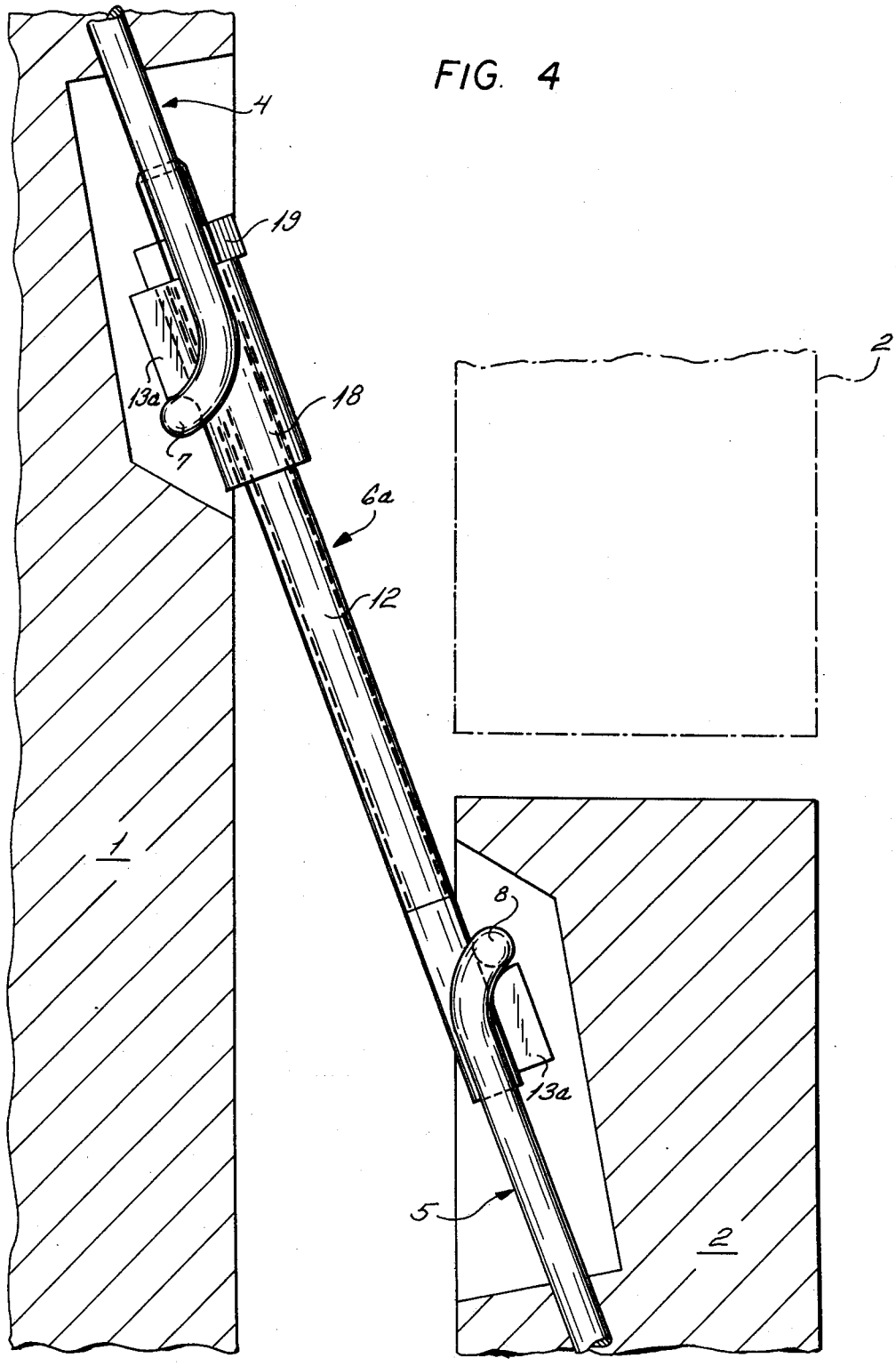

The arrangement shown in FIG. 4 has the anchor 4 of the wall 1 connected to the anchor 5 of the wall 2 by means of a hanger 6*a* constituted as a threaded rod 12 to one end of which is welded a crosspiece 13*a* and along which is slidable a sleeve 18 carrying another such crosspiece 13*a*. A nut 19 and lock nut if desired are provided outside the sleeve 18 so that rotation of this nut 19 can displace the sleeve 18 and the crosspiece 13*a* thereon toward the other crosspiece 13*a*, thereby changing the effective length of the hanger 6*a* between its ends. Such a connecting arrangement is extremely inexpensive to manufacture, very strong, and has a wide range of adjustability.

The connector 6*b* of FIGS. 5 and 6 has a rod 20 formed with a thread 21 and provided with two end pieces 13*b* constituted as heavy blocks slidable along the rod 20 and displaceable inwardly by nuts 22 carried on the thread 21. Lock nuts 19 exactly position the head blocks 13*b*.

In this arrangement each of the anchors 4 and 5 is constituted by a pair of cable loops 23 and 24 each received within a respective saddle-like groove or seat 25 in the respective head block 13*b*. FIG. 6 shows how the seats 25 are circularly arcuate and of relatively large radius of curvature so that the positioning bolts 22 are readily accessible for rotation by an open-end wrench or the like.

The cable constituting the loops 23 and 24 is surrounded immediately below the respective pocket in the respective element by a large pressed-on sleeve 14. Such a sleeve 14 not only secures together the ends of the piece of cable forming the closed loop, but greatly stabilizes the cable in the arrangement.

The facade slab 2 is spaced from the wall slab 1 by a spacer 27 having a foot 29 braced against the wall 1 and a threaded shank received within a sleeve 28 in the plate 2. A lock nut 30 serves to prevent rotation of the foot 29 after the plate 2 is properly positioned.

Figure 7:
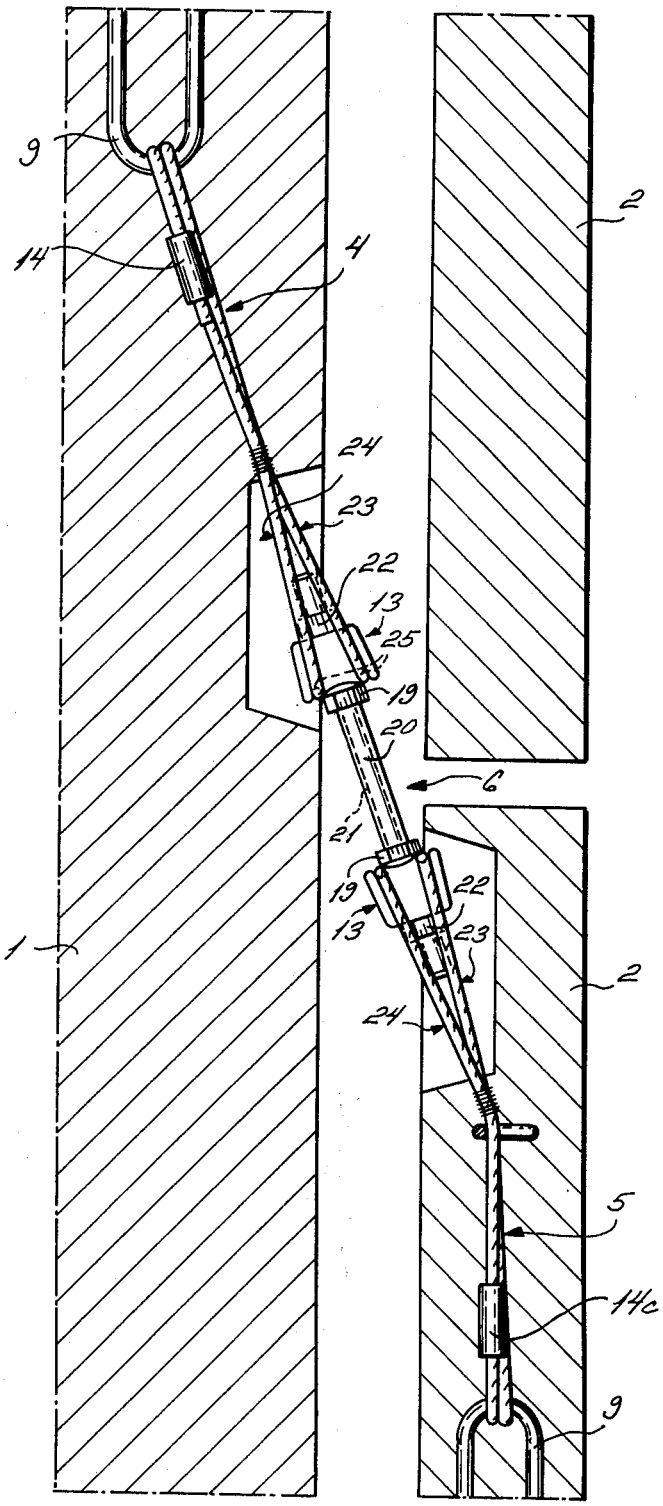
FIG. 7 is a vertical section taken through a further arrangement according to the present invention.

The arrangement of FIG. 7 is identical to that of FIGS. 5 and 6 except that here the sleeve 14*b* is replaced by a sleeve 14*c* that merely joins together the ends of the single piece of cable forming the two loops 23 and 24.

I claim:

1. A wall assembly comprising:
   an upright wall having a front face;
   a loop of stranded wire rope anchored in said wall and projecting from said face;
   a facade plate having a back face turned toward said front face;
   a loop of stranded wire rope anchored in said plate and projecting from said back face;
   an elongated rigid hanger having an upper end hooked into the wall loop and a lower end hooked into the facade loop, whereby said facade plate is suspended by said hanger from said wall; and
   means for varying the length of said hanger between its said ends.

2. The assembly defined in claim 1 wherein said wire rope is steel.

3. The assembly defined in claim 2 wherein said hanger is formed of at least two elements each engaging a respective one of said loops, said means including a screw thread on at least one of said elements.

4. The assembly defined in claim 3 wherein each loop is formed of substantially inextensible steel stranded wire rope and constitutes a part of an endless piece of such rope imbedded beneath the respective face.

5. The arrangement defined in claim 3 wherein said elements each have a threaded shank and said hanger includes a sleeve formed with said screw thread and engaged with both of said elements.

6. The assembly defined in claim 5 wherein said screw thread has a portion of one hand threadedly engaged with one of said elements and a portion of opposite hand threadedly engaged with the other element, wherby rotation of said sleeve in one sense approaches said elements toward each other and rotation in the opposite sense moves said elements away from each other.

7. The arrangement defined in claim 6 wherein each of said elements is generally T-shaped and has a crosspiece, the respective loop being engaged around the respective crosspiece.

8. The arrangement defined in claim 3 wherein one of said elements has a shaft formed with said thread, the other element being slidable along said shaft, said hanger being provided with a nut on said shaft and engageable against said other element and rotatable to displace same along said one element.

9. The assembly defined in claim 3 wherein a pair of such loops project from said front face and a similar pair of such loops project from said back face, said one element being formed with a pair of seats for the respective pair of loops and the other element being formed with a pair of seats for the respective pair of loops.

10. The assembly defined in claim 9 wherein said hanger includes an elongated threaded rod and a pair of nuts on said rod, each of said elements being slidable along said rod and longitudinally braceable against a respective one of said nuts.

11. A facade element for hanging on an upright wall via a hanger, said element comprising a rigid plate having a back face adapted to be turned toward said wall and provided with a loop of flexible stranded wire rope projecting from said back face and adapted to be hooked by said hanger for securing said plate to said wall.

12. In a wall construction wherein a facade member is mounted upon a support member by an adjustable length hanger engaging loop elements on said members, the improvement wherein at least one of said members is composed of concrete and the corresponding loop element is a wire rope embedded in the concrete.

* * * * *